United States Patent [19]

Tyson, Jr. et al.

[11] Patent Number: 4,889,618

[45] Date of Patent: Dec. 26, 1989

[54] TREATMENT OF CATALYST FINES-OIL MIXTURES

[76] Inventors: William H. Tyson, Jr., 1874 School St., Moraga, Calif. 94556; Frank A. Stuart, 631 Zinnia Ct., Sonoma, Calif. 95476

[21] Appl. No.: 276,624

[22] Filed: Nov. 28, 1988

[51] Int. Cl.[4] ..... C10G 19/02; C10G 35/00

[52] U.S. Cl. ..... 208/162; 208/153; 208/158; 208/159; 208/161; 208/177; 208/113; 208/121; 208/283; 208/284; 208/298

[58] Field of Search ..... 208/177, 162, 153, 158, 208/159, 161, 286, 283, 284, 285, 288, 298

[56] References Cited

U.S. PATENT DOCUMENTS

| | | | |
|---|---|---|---|
| 2,879,224 | 3/1959 | Lawson | 208/162 |
| 3,051,314 | 8/1962 | Conn | 208/162 |
| 4,085,029 | 4/1978 | Malek | 208/429 |
| 4,158,622 | 6/1979 | Schwarzenbeck | 208/177 |
| 4,159,240 | 6/1979 | Melet | 208/177 |
| 4,345,991 | 8/1982 | Stegelman | 208/162 |
| 4,539,099 | 9/1985 | Merchant | 208/177 |
| 4,559,133 | 12/1985 | Siegfried et al. | 208/177 |
| 4,584,087 | 4/1986 | Peck | 208/161 |
| 4,810,360 | 3/1986 | Haddad et al. | 208/153 |

*Primary Examiner*—Helane Myers

*Attorney, Agent, or Firm*—Limbach, Limbach & Sutton

[57] ABSTRACT

A process for separating finely divided petroleum cracking catlyst from a mixture of the finely divided catalyst particles with a high boiling refractory hydrocarbon oil by intimately contracting said mixture with a concentrated aqueous solution of a basic alkali metal compound at a temperature above 170° F., the quantity of aqueous solution employed being substantially greater than the quantity of said mixture with which it is contracted.

7 Claims, No Drawings

TREATMENT OF CATALYST FINES-OIL MIXTURES

BACKGROUND OF THE INVENTION

About half of the gasoline used in the United States is obtained by fluid catalytic cracking of petroleum. A fluid catalytic cracking unit consists of a cracking reactor, a catalyst regenerator and a fractionater. The catalyst employed is generally finely divided silica-alumina catalyst to which small quantities of finely divided large-pore zeolites are added to increase activity. The catalyst particles range in size from about 20 to 200 microns in diameter. The cracking reactor contains a bed of hot catalyst. Hot heavy petroleum fractions are passed into the catalyst bed which is maintained in a fluidized condition by passage of the feed and the cracked products thru it.

Catalyst in the reactor loses activity as a result of coke deposition on its surface during the cracking reaction. Catalyst is continuously withdrawn from the bottom of the cracking reactor and passed to the regenerator. In the regenerator the coked catalyst is contacted with hot air which burns coke from the catalyst surface and heats the catalyst to cracking temperature. Hot regenerated catalyst is withdrawn from the regenerator and returned to the cracking reactor together with additional petroleum to be cracked. Cyclone separators are disposed in the top of the reactor and separate most of the suspended catalyst particles from the cracked product which is removed from the top of the reactor and passed into the fractionating unit where light gases, gasoline, heating oil and heavy fuel oil fractions are separated and withdrawn as products. A small quantity of refractory hydrocarbons accumulates in the bottom of the fractionator. This refractory hydrocarbon material, which is commonly called slurry oil, contains a very small quantity of very finely divided (ca. 20 micron and smaller) catalyst particles which are not removed from the cracked products by the cyclone separators.

Slurry oil containing a very small fraction of a percent of catalyst fines is withdrawn from the bottom of the fractionater and passed into a very large tank where the catalyst fines settle. Periodically slurry oil is decanted from the tanks. Over a long period, usually three to five years, the tank is filled and may hold from three to eight thousand tons of slurry oil-catalyst fines mixture. The mixture is about 50% by weight of oil and 50% by weight of catalyst fines overall but concentration of fines is greatest near the tank bottom.

When the tank is filled it is opened and the oil-fines mixture is removed for disposal. Disposal is generally by incineration or by burial in a land fill area. Both methods of disposal have serious disadvantages. Incineration is expensive and wasteful, burial of the oil-fines mixture results in soil pollution at the dumpsites and contamination of subterranean water with polynuclear aromatic hydrocarbons contained in the oil which may be carcinogenic.

The means of disposing of slurry oil-catalyst fines mixtures must be improved.

BRIEF DESCRIPTION OF THE INVENTION

It has now been found that a large proportion of the slurry oil contained in the oil-fines mixture may be removed from the mixture by forming a hot dispersion of the oil-fines mixture in a concentrated aqueous solution of a treating agent which is an alkali metal hydroxide, an alkali metal carbonate, alkali metal phosphate or an alkali metal borate and then settling the dispersion to form two phases, an upper oil phase and a lower aqueous phase which is a slurry of catalyst-fines in the aqueous solution employed. The oil phase is withdrawn for use as a fuel, the aqueous phase is filtered to separate a catalyst fines filter cake. By far the greater part of the oil contained in the oil-catalyst fines mixture is recovered in the oil phase. The filter cake contains from about 5 to 10% by weight of unseparated oil. If desired the filter cake can be buried in a land fill area with minimized danger of ground water pollution but the filter cake is much better disposed of by using it as filler in roofing asphalt.

The aqueous solutions in which the oil-fines mixtures are dispersed contain from 10 to 25% by weight of the alkali metal solute. Sodium hydroxide, sodium tetra borate and sodium carbonate are the preferred solutes over the other alkali, metal solutes on a cost basis.

The temperature at which the dispersion of the oil-fines mixture in the alkali metal solute solution takes place must be high. The temperature should be above 170° F. and preferably above 212° F.

The total quantity of treating agent in which the oil-fines mixture is dispersed is generally in the range 300 to 600 cc's of treating agent per 100 grams of oil fines mixture. The treating agent is preferrably added in two increments. The first increment is usually about 30 to 100 cc's of treating agent per 100 grams of oil-fines mixture and this increment is very vigorously mixed with the oil-fines mixture. The second increment of treating agent added is sufficient to bring the total treating agent added to 300 to 600 cc's per 100 grams of oil-fines mixture being treated. The second increment is added with gently stirring to make a uniform mixture. After addition of the second increment the resultant mixture is settled to form an upper oil phase which is essentially free of catalyst fines and a lower aqueous phase in which the catalyst fines are at the phase bottom.

The high concentration of the alkali metal solute in the treating agent, the high temperature at which the treating agent and oil-fines mixture are in contact with each other and the large volume of treating agent relative to quantity of oil-fines mixture being treated results in rapid separation of oil from catalyst fines, in an oil product which is essentially free of catalyst fines and in a catalyst fines product with greatly reduced oil content.

The following examples describe the treating of slurry oil-catalyst fines mixtures with aqueous solutions of alkali metal hydroxide, alkali metal carbonates and alkali metal borates.

EXAMPLE 1

A quantity of a catalyst-fines-heavy oil mixture was removed from a tank in which bottoms from the fractionating column in which the effluent from a fluid catalytic cracking reactor was distilled were stored. The fines-oil mixture was heavy paste-like material which would flow only very slowly at room temperature but which flowed more readily at 150° F. and could be stirred readily at 200° F. The material contained 39% by weight oil and 61% by weight of very finely divided (ca. 20 micron) catalyst particles.

A 20% solution of soda ash was prepared and heated to 170° F. Thirty eight cc's of this solution was fed into a 100-gram sample of the above slurry-fines mixture (which had been preheated in a beaker to 170° F.) at a uniform rate over a period of six minutes. During this addition, the mixture was stirred vigorously and moderate agitation was continued for an additional six minutes after the 38 cc's had been added. At this point the mixture was diluted with gentle stirring to a total volume of 300 cc's with the same soda ash solution at 170° F. The mixture separated into three layers almost immediately and 50 cc's of clear dark oil floated to the top of the beaker. Below this a cloudy aqueous phase formed with 75 cc's of recovered fines and aqueous solution at the bottom of the beaker. After standing for five minutes, the oil layer decreased to 45 cc's (38 grams) and the recovered fines volume increased to 90 cc's. Separation of oil from the catalyst fines was almost complete.

EXAMPLE 2

One hundred grams of the fines-oil mixture described in Example 1 was heated in an oven to a temperature of 150° F. A 15% solution of sodium hydroxide was prepared and heated to the boiling point. Thirty eight cc's of this solution was added to the slurry-fines mixture over a period of six minutes with vigorous stirring. The temperature was maintained at around 150° F. The mixture was then allowed to heat soak with gentle stirring for another six minutes. Two hundred cc's of hot 15% sodium hydroxide was added to the mixture and stirring was discontinued. The mixture was allowed to stand in an oven at 50° F. After half an hour, 30 cc's of clear dark oil floated on the surface and 100 cc's of catalyst fines had settled to the bottom. This oil yield represents a 77% recovery of oil from the oil-fines mixture. The lower temperature employed in this example resulted in reduced oil recovery.

EXAMPLE 3

Two hundred grams of the oil-fines mixture described in Example 1 was heated to 218° F. and added over a period of one minute to 75-cc's of 15% sodium hydroxide. The mixture was then stirred for eleven minutes just below the boiling point and then diluted to 500 cc's with additional 15% sodium hydroxide solution. The mixture was allowed to stand in the oven for 40 minutes and at the end of that period, 75 cc's of excellent quality oil had risen to the surface, indicating a recovery of 95% of the oil in the original sample.

EXAMPLE 4

Two hundred grams of the oil-fines mixture described in Example 1 were heated to 212° F. and poured into 90 cc's of 15% soda ash solution over a period of one minute. The mixture was then stirred at the same temperature for eleven minutes and then diluted to 500 cc's with the same soda ash solution. In five minutes, 90 cc's of oil had floated to the surface and a good separation resulted. This oil had small amounts of water and recovered fines dispersed in it which would have required settling at elevated temperatures to give clear oil.

EXAMPLE 5

Two hundred grams of the fines-oil mixture described in Example 1 were heated to 215° F. in an oven. A 12% solution of soda ash was heated to the boiling point and 75 cc's of this solution was added to the oil-ash mixture in a 600-cc beaker over a period of three minutes with vigorous agitation. The mixture was held on temperature for another six minutes with mild agitation and diluted to a total of 500 cc's with the same soda ash solution. After three hours standing in an oven at 205° F., 70 cc's of oil had separated. This was removed and the remaining mixture reagitated with a spatula. After standing for five minutes, 15 cc's of additional oil had been released and floated to the surface. This was removed and agitation repeated, releasing a third layer of oil amounting to about 3 cc's. The fines were worked up by filtration and drying. Methylene chloride extraction of the fines in a Soxhlet apparatus indicated that the recovered fines contained 8.2% oil.

EXAMPLE 6

An oil-fines mixture containing 37% by weight of heavy slurry oil and 63% by weight of very finely divided catalyst was obtained from a refinery tank in which bottoms from the column used for fractionating the effluent from a fluid catalytic cracking unit were stored. One hundred fifty grams of this mixture was heated to 230° F. A 12% solution of borax was heated to the boiling point and 60 cc's of this solution was added in one minute with vigorous agitation to the oil-fines mixture. The mixture was heated for an additional 12 minutes with gentle agitation and then diluted to 260 cc's with the same solution of borax. Oil immediately rose to the surface above a suspension of recovered catalyst fines in water. After standing for half an hour at 210° F., the mixture was worked up and analysis of the recovered catalyst fines indicated an oil content of 9%.

EXAMPLE 7

Example 6 was repeated with the difference that 100 cc's of the borax solution were added over a 1.5 minute period and the mixture after dilution was heated for an additional 15 minutes. The oil content of the treated fines was 9% by weight.

EXAMPLE 8

One hundred fifty grams of the oil-fines mixture of Example 6 was heated to 215° F. A 15% solution of sodium hydroxide was prepared and heated to the boiling point. One hundred cc's of this solution was added over a period of ten minutes to the oil-fines mixture with stirring. The mix was heated for one minute longer with stirring and then diluted to 500 cc's with hot 15% sodium hydroxide. After standing for four minutes without agitation, 60 cc's of oil had risen to the surface and the fines had settled to the bottom of the beaker. After filtering and drying, the recovered fines had an oil content of 5.7%.

The applications of the treating as described in the example shows that the treating method recovers a large proportion of the oil contained in the mixtures treated and that the catalyst fines contained in the mixtures treated are recovered and have oil contents in the range 5 to 10%.

EXAMPLE 9

One hundred fifty grams of the oil-fines mixture used in Example 6 was heated to about 215° F. A 15% solution of trisodium phosphate was prepared and heated to approximately the same temperature. Eighty five cc's of this solution was added over a period of 12 minutes to the oil-fines mixture with continuous stirring. The mixture was heated for five minutes longer with the same stirring rate. The rate of agitation was then reduced significantly so that the mixture was barely being agitated. Four hundred fifty cc's of hot 15% trisodium phosphate was then added slowly and slow agitation continued for two minutes. Agitation was discontinued and the mixture allowed to settle. After five minutes 58 cc's of oil had risen to the surface and the fines had settled to the bottom of the reactor. After filtering and drying the recovered fines had an oil content of 6.2%.

We claim:

1. A process for treating slurry oil-catalyst fines mixtures produced in the course of cracking petroleum by the fluid catalytic cracking process which comprises:

(a) forming a dispersion of the oil-fines mixture in a treating agent consisting essentially of a concentrated aqueous solution of a compound selected from the group consisting of alkali metal hydroxides, alkali metal carbonates, alkali metal phosphate and alkali metal borates, the quantity of treating agent employed being substantially greater than the quantity of oil-fines mixture employed in forming the dispersion;

(b) subjecting the resulting dispersion to vigorous mixing while holding the dispersion at a temperature above 170° F.;

(c) discontinuing the mixing and settling the dispersion while maintaining the temperature above 170° F. to form an upper oil phase substantially free of catalyst fines and a lower aqueous phase containing catalyst fines; and (d) recovering the oil phase.

2. The process defined in claim 1 wherein the volume of treating agent employed in forming the dispersion consists of an initial increment of 30 to 60 cc's per 100 grams of oil-fines mixture and a second increment bring the total treating agent added to the oil-fines mixture to about 200 to 600 cc's per 100 grams of oil-fines mixture, the first increment being vigorously mixed with the oil-fines mixture and the second increment being added with gentle stirring.

3. The method of claim 1 wherein the treating agent is a sodium carbonate solution.

4. The method of claim 1 wherein the dispersion is held at a temperature above 200° F. during the vigorous mixing.

5. The method of treating a slurry oil-fluid cracking catalyst fines mixture to separate slurry oil essentially free of fines and catalyst fines containing less than 10% by weight of slurry oil which comprises adding about 20 to 60 cc's of a treating solution per 100 grams of said oil-fines mixture, vigorously mixing said treating solution and oil-fines mixture at an elevated temperature above 170° F., then diluting said intimate mixture with about 200 to 500 cc's of additional treating agent while maintaining said elevated temperature, settling said diluted mixture to separate an upper oil phase substantially free of catalyst fines and a lower aqueous phase containing catalyst fines having an oil content in the range 5 to 10% by weight, filtering the aqueous phase to separate catalyst fines as a filter cake, the treating solution being an aqueous solution containing from about 10 to 20% by weight of a compound selected form the group consisting of alkali metal hydroxides, alkali metal carbonates alkali metal phophates and alkali metal borates.

6. The method of claim 5 wherein the treating agent is a sodium carbonate solution.

7. The method of claim 5 wherein the temperature above 200° F. during the vigorous mixing.

* * * * *